US007860440B2

(12) United States Patent
Miyata et al.

(10) Patent No.: US 7,860,440 B2
(45) Date of Patent: Dec. 28, 2010

(54) FIXING DEVICE, IMAGE FORMING APPARATUS AND METHOD FOR CONTROLLING FIXING DEVICE

(75) Inventors: Toshiyuki Miyata, Kanagawa (JP); Yasuhiro Uehara, Kanagawa (JP); Yasushi Kawahata, Kanagawa (JP); Daisuke Yoshino, Kanagawa (JP); Chikara Ando, Kanagawa (JP); Junpei Amano, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 682 days.

(21) Appl. No.: 11/527,575

(22) Filed: Sep. 27, 2006

(65) Prior Publication Data

US 2007/0172272 A1 Jul. 26, 2007

(30) Foreign Application Priority Data

Jan. 26, 2006 (JP) ..... P2006-018089

(51) Int. Cl.
*G03G 15/20* (2006.01)

(52) U.S. Cl. ..... 399/329; 399/165

(58) Field of Classification Search ..... 399/165, 399/329

See application file for complete search history.

(56) References Cited

U.S. PATENT DOCUMENTS

| | | | | |
|---|---|---|---|---|
| 7,013,107 | B2 | 3/2006 | Russel et al. | |
| 2007/0048035 | A1 * | 3/2007 | Baba et al. | 399/323 |

FOREIGN PATENT DOCUMENTS

| | | | |
|---|---|---|---|
| JP | 63-193168 | | 8/1988 |
| JP | 3-133871 | | 6/1991 |
| JP | 06091398 | A * | 4/1994 |
| JP | 11020973 | A * | 1/1999 |
| JP | 2003-5566 | | 1/2003 |
| JP | 2005070278 | A * | 3/2005 |
| JP | 2005-182028 | | 7/2005 |

* cited by examiner

*Primary Examiner*—David M Gray
*Assistant Examiner*—Roy Yi
(74) *Attorney, Agent, or Firm*—Morgan, Lewis & Bockius LLP

(57) ABSTRACT

A fixing device fixes a toner image carried on a recording medium. The fixing device includes a rotatable fixing roll member, a fixing belt member and a walk adjustment mechanism. The fixing belt member is wound on the fixing roll member so as to be rotatable. The walk adjustment mechanism changes a walk width of the fixing belt member in accordance with a width of the recording medium.

10 Claims, 7 Drawing Sheets

FIXING DEVICE, IMAGE FORMING APPARATUS AND METHOD FOR CONTROLLING FIXING DEVICE

BACKGROUND

1. Technical Field

This invention relates to a fixing device used in an image forming apparatus utilizing an electrophotography system, for example, and more particularly to a fixing device including a rotatable belt member.

2. Description of the Related Art

A fixing device has proposed in which a heating member for heating a recording paper is formed of a film-like belt member (fixing belt).

In recent years, it has been proposed that a wax component is contained in toner and that a film (peel layer) made of a fluorocarbon resin having releasability is formed on the surfaces of the fixing roll and the fixing belt to make oilless.

In a fixing device wherein a peel layer made of a fluorocarbon resin is formed on the surfaces of a fixing roll and a fixing belt, the peel layers on the surfaces of the fixing roll and the fixing belt wear due to side edges of recording paper to be fixed. If the wearing of the peel layers proceeds, the quality of the fixed image may be degraded.

SUMMARY

According to an aspect of the invention, a fixing device fixes a toner image carried on a recording medium. The fixing device includes a rotatable fixing roll member, a fixing belt member and a walk adjustment mechanism. The fixing belt member is wound on the fixing roll member so as to be rotatable. The walk adjustment mechanism changes a walk width of the fixing belt member in accordance with a width of the recording medium.

BRIEF DESCRIPTION OF THE DRAWINGS

Exemplary embodiments of the invention will be described in detail based on the following figures, wherein.

DETAILED DESCRIPTION

Referring now to the accompanying drawings, exemplary embodiments of the invention will be described below.

Figure 1:
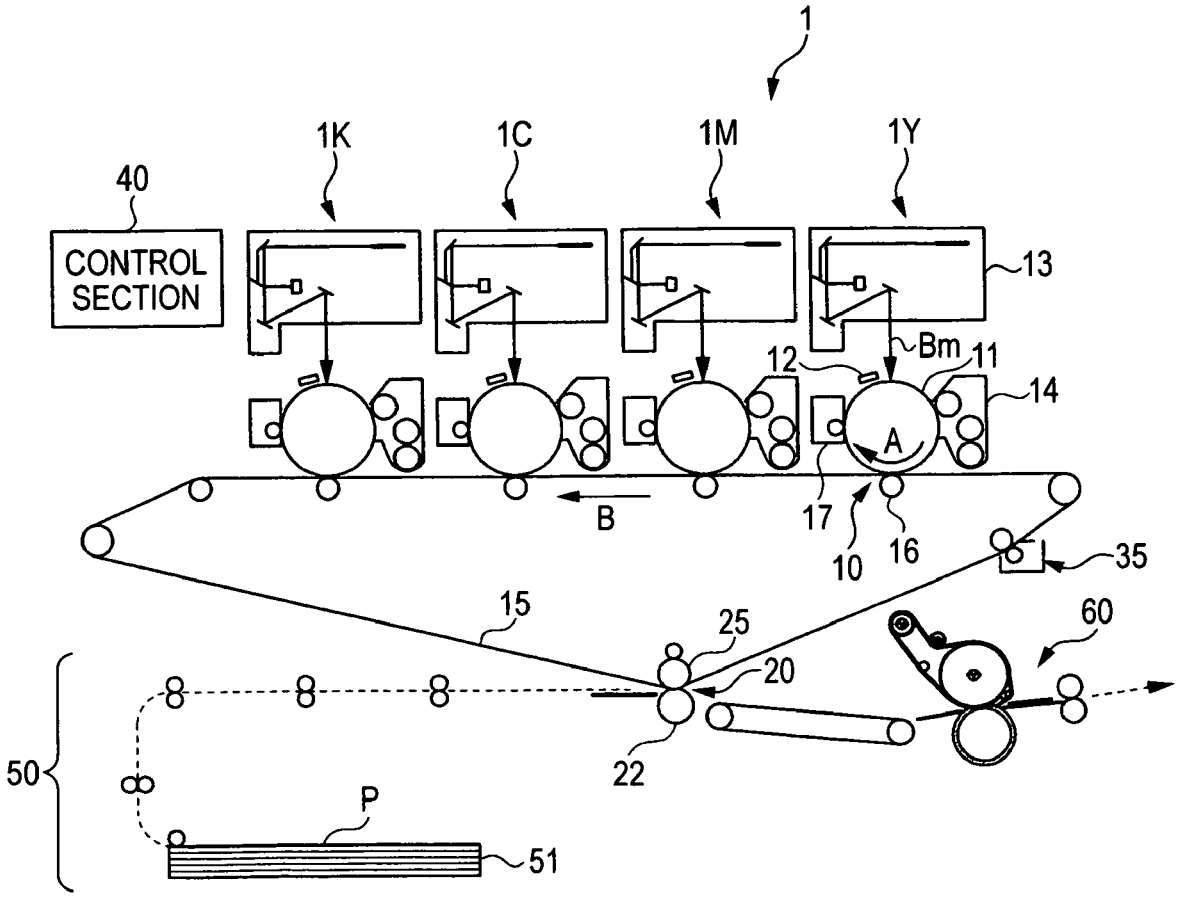
FIG. 1 is a schematic configuration drawing of an image forming apparatus incorporating an exemplary embodiment of the invention.

FIG. 1 is a schematic configuration drawing to show an image forming apparatus 1 incorporating an exemplary embodiment of the invention. The image forming apparatus 1 shown in FIG. 1 adopts an intermediate transfer system called a "tandem type". The image forming apparatus includes plural image forming units 1Y, 1M, 1C, and 1K and primary transfer sections 10. Each of the image forming units 1Y, 1M, 1C, and 1K serve as an image forming unit that forms a toner image of a corresponding color component based on the electrophotography system. The primary transfer sections 10 transfer the color-component toner images formed by the image forming units 1Y, 1M, 1C, and 1K onto an intermediate transfer belt 15 in order (primary transfer). The image forming apparatus 1 also includes a secondary transfer section 20 and a fixing device 60. The secondary transfer section 20 serves as a transfer unit that transfers the superposed toner images transferred onto the intermediate transfer belt 15 to a recording paper P, which is an example of a recording medium (secondary transfer). The fixing device 60 fixes the secondarily transferred image onto the recording paper P. The image forming apparatus 1 further includes a recording-paper transport mechanism 50 and a control section 40. The control section 40 serves as a control unit that controls operations of the respective components of the image forming apparatus 1.

Each of the image forming units 1Y, 1M, 1C, and 1K includes a photosensitive drum 11 that rotates in the arrow A direction shown in the image forming unit 1Y as a representative (see FIG. 1). A charger 12, a laser exposure device 13 and a developing device 14 are provided in the surroundings of the photosensitive drum 11. The charger 12 charges the photosensitive drum 11. The laser exposure device 13 writes an electrostatic latent image onto the photosensitive drum 11 (in FIG. 1, a reference sign Bm represents an exposure laser beam). The developing device 14 stores color-component toner for visualizing with the toner the electrostatic latent image formed on the photosensitive drum 11. Further, a primary transfer roll 16 and a drum cleaner 17 are provided. The primary transfer roll 16 transfers the toner images of the respective color components formed on the photosensitive drum 11 to the intermediate transfer belt 15 in the primary transfer section 10. The drum cleaner 17 removes remaining toner on the photosensitive drum 11. The image forming units 1Y, 1M, 1C, and 1K are placed on a substantial straight line in order of yellow (Y), magenta (M), cyan (C), and black (K) from the upstream side of the intermediate transfer belt 15.

The intermediate transfer belt 15 is wound on various rolls so as to have a passage extending roughly straightly along the arrangement direction of the photosensitive drums 11. The intermediate transfer belt 15 is circulated (turned) at predetermined speed in the arrow B direction shown in FIG. 1.

The primary transfer section 10 includes the primary transfer roll 16 placed to face the photosensitive drum 11 with the intermediate transfer belt 15 disposed between the primary transfer roll 16 and the photosensitive drum 11. The primary transfer roll 16 presses the intermediate transfer belt 15 against the photosensitive drum 11. A voltage having an opposite polarity to a toner charge polarity (primary transfer bias) is applied to the primary transfer roll 16. Accordingly, the toner images on the photosensitive drums 11 are electrostatically attracted onto the intermediate transfer belt 15 in order, and the superposed toner images are formed on the intermediate transfer belt 15.

The secondary transfer section 20 includes a secondary transfer roll 22 and a backup roll 25. The secondary transfer roll 22 is disposed on a toner-image support side of the intermediate transfer belt 15. The backup roll 25 is disposed to face the secondary transfer roll 22 with the intermediate transfer belt 15 disposed between the backup roll 25 and the secondary transfer roll 22.

A secondary transfer bias is applied to the backup roll 25 and the secondary transfer roll 22 is grounded. That is, the secondary transfer bias is formed between the secondary transfer roll 22 and the backup roll 25. The toner images carried on the intermediate transfer belt 15 are secondarily transferred onto a recording paper, which are being fed.

An intermediate-transfer-belt cleaner 35 is disposed on the downstream side of the secondary transfer section 20 of the intermediate transfer belt 15. The intermediate-transfer-belt cleaner 35 removes the remaining toner and paper powder on the intermediate transfer belt 15 and cleans the surface of the intermediate transfer belt 15.

The recording-paper transport mechanism 50 transports a recording paper P from a recording paper tray 51, which stores the recording paper P, to the secondary transfer section 20. The recording-paper transport mechanism 50 also transports to the fixing device 60 the recording paper P onto which the toner images are transferred (secondarily transferred) in the secondary transfer section 20.

The image forming apparatus 1 forms an image under the control of the control section 40 as follows.

Color toner images are formed on the photosensitive drums 11 of the image forming units 1Y, 1M, 1C, and 1K based on image data output from an image reader (not shown) or a personal computer (not shown). To form the toner image in each of the image forming units 1Y, 1M, 1C, and 1K, the laser exposure device 13 scans over the photosensitive drum 11 charged by the charger 12 for exposing the photosensitive drum 11 to light so as to form an electrostatic latent image thereon. Then, the developer 14 develops the electrostatic latent image with toner.

Next, the toner images formed on the photosensitive drums 11 of the image forming units 1Y, 1M, 1C, and 1K are superposed on each other on the intermediate transfer belt 15 in the primary transfer sections 10. Then primarily transferred toner images are electrostatically transferred onto the recording paper P being transported by the recording-paper transport mechanism 50, in the secondary transfer section 20.

Then, the recording-paper transport mechanism 50 transports to the fixing device 60 the recording paper P onto which the toner images are transferred. Then, the fixing device 60 fixes the toner images onto the recording paper P with heat and pressure. The recording paper P is discharged to an discharged paper placement section (not shown).

Next, the fixing device 60 of the exemplary embodiment of the invention will be described in detail.

Figure 2:
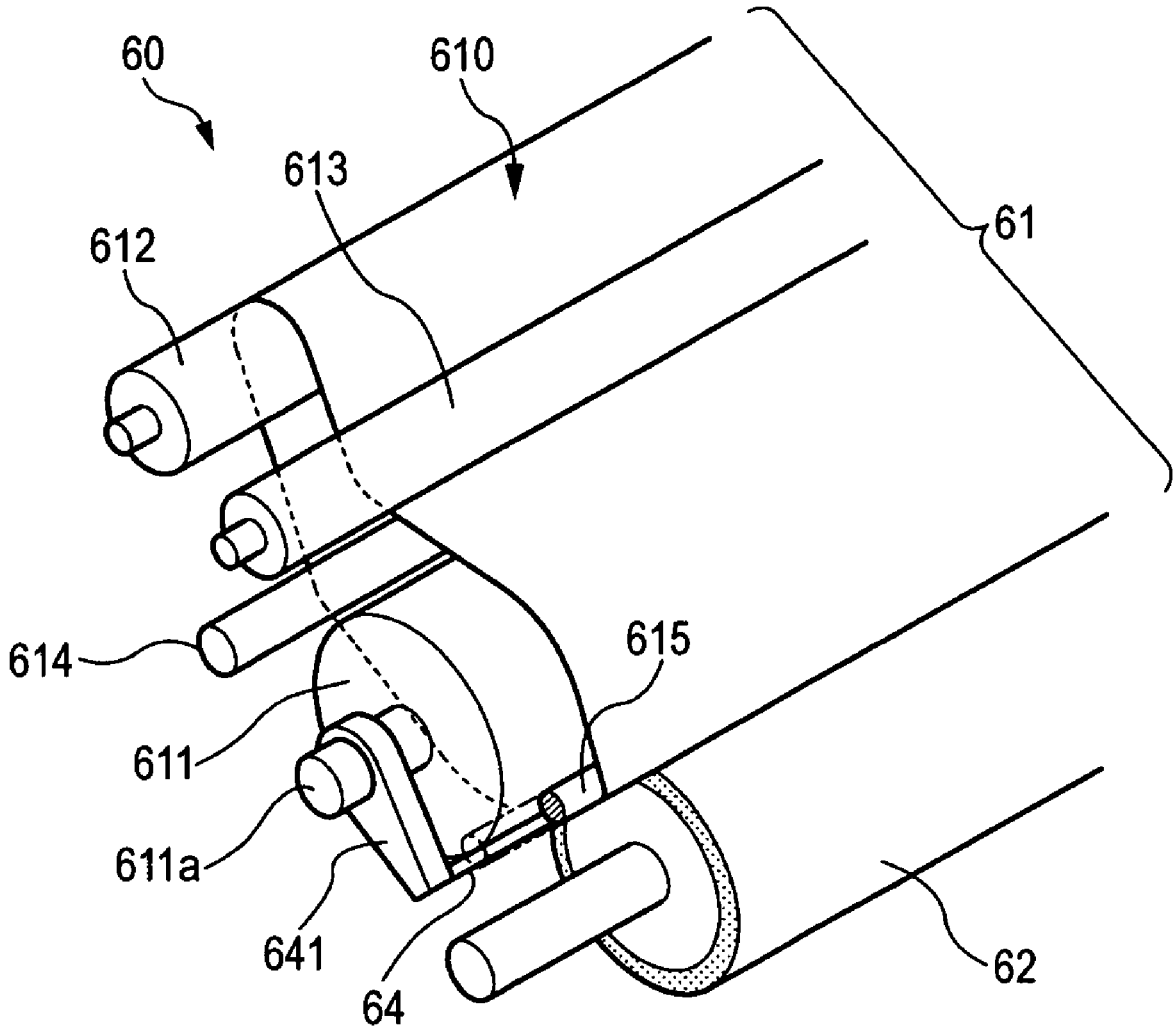
FIG. 2 is a perspective view to schematically show one end of a fixing device.
Figure 3:
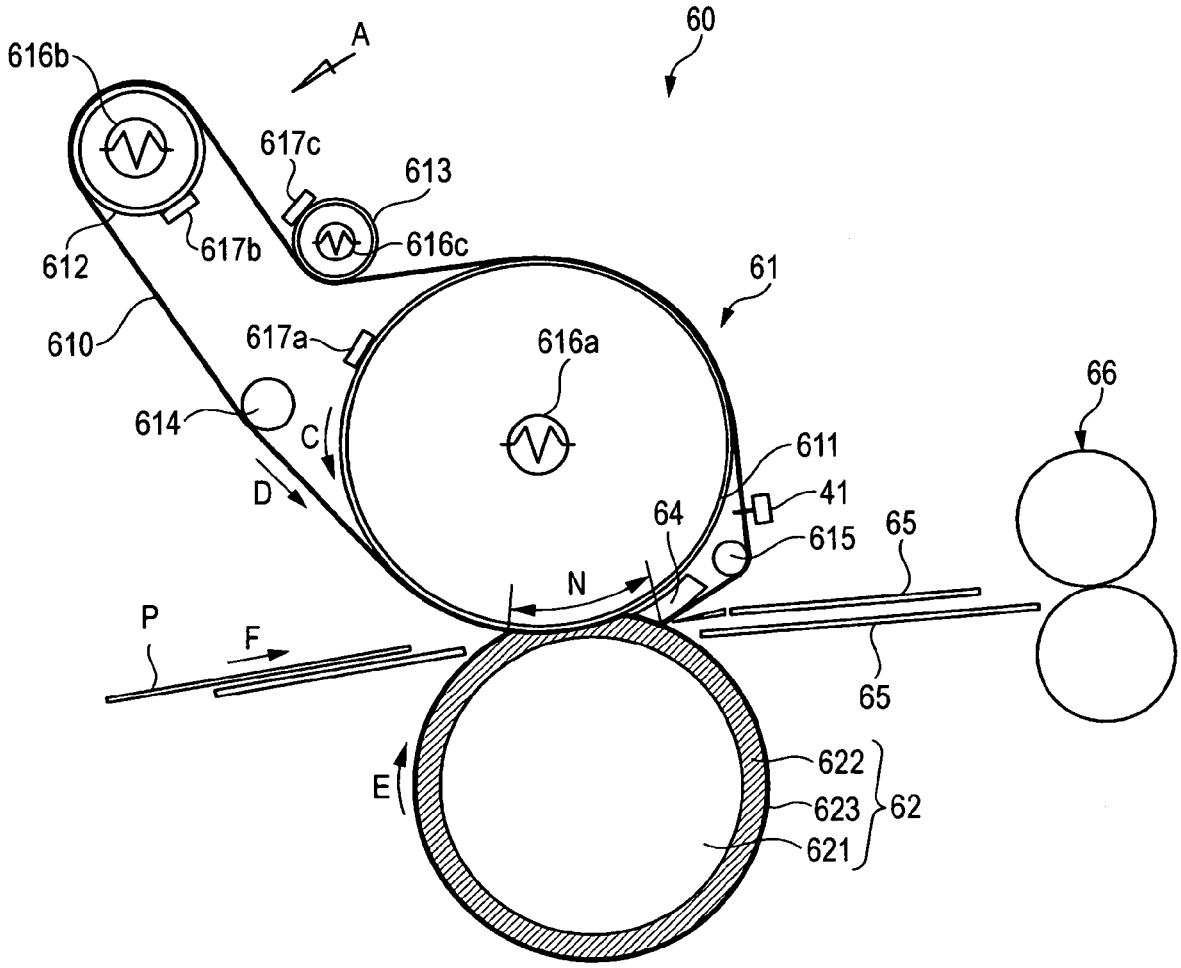
FIG. 3 is a sectional side view to show the schematic configuration of the fixing device.
Figure 4:
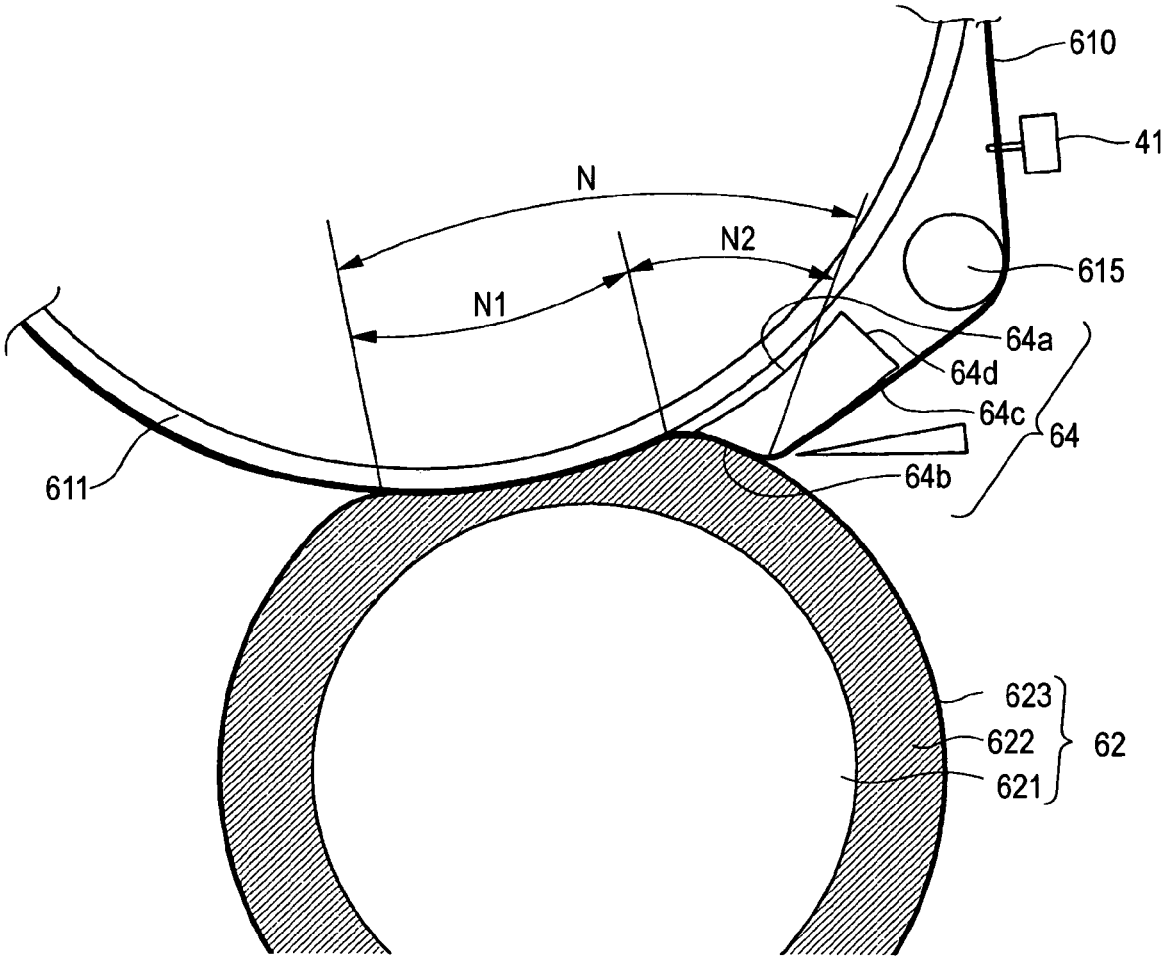
FIG. 4 is a schematic sectional view to show an area in the vicinity of a nip portion.
Figure 5:
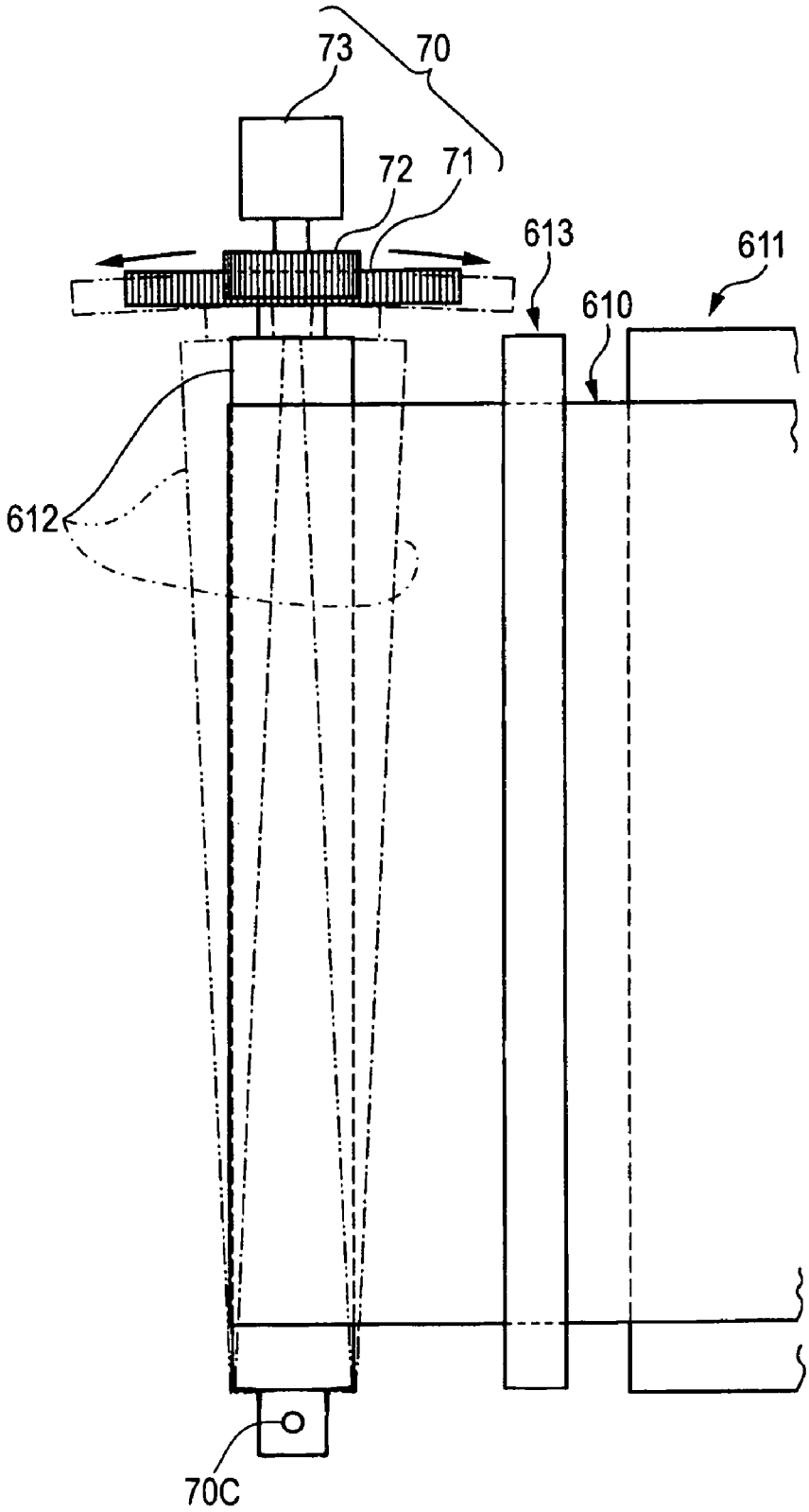
FIG. 5 is a schematic configuration drawing of a walk adjustment mechanism when viewed from an A arrow shown in FIG. 3.

FIG. 2 is a perspective view to schematically show one end of the fixing device 60 according to the exemplary embodiment. FIG. 3 is a sectional side view to show the schematic configuration of the fixing device 60. FIG. 4 is a schematic sectional view showing an area in the vicinity of the nip portion N. FIG. 5 is a schematic view to show the schematic configuration of a walk adjustment mechanism 70 when viewed from an A arrow shown in FIG. 3.

The fixing device 60 includes a fixing belt module 61 and a pressure roll 62. The fixing belt module 61 includes a fixing belt 610. The pressure roll 62 serves as a pressure member and is pressed against the fixing belt module 61. The fixing device 60 provides a nip portion N between the fixing belt module 61 and the pressure roll 62. In the nip portion N, a recording paper P is heated and pressurized to fix toner images on the recording paper P. The nip portion N includes a roll nip portion N1 and a peel-pad nip portion N2.

The fixing belt module 61 includes the fixing belt 610 serving as a fixing belt member, the fixing roll 611 serving as a fixing roll member that drives and rotates the fixing belt 610, which is wound thereon, and a tension roll 612 serving as a tension roll member on which the fixing belt 610 is wound. The tension roll 612 gives a tension force to the fixing belt 610 from the inside of the fixing belt 610. The fixing belt module 61 also includes tension rolls 613 and 614. The tension roll 613 is disposed outside the fixing belt 610 and defines a circulation passage of the fixing belt 610. The tension roll 614 is disposed outside the fixing belt 610 between the fixing roll 611 and the tension roll 612. The tension roll 614 also defines the passage of the fixing belt 610. The fixing belt module 61 further includes a peel pad 64 and a tension roll 615. The peel pad 64 serves as a peel member is disposed in the vicinity of the fixing roll 611 and on the downstream side of the nip portion N where the fixing belt module 61 and the pressure roll 62 are in pressure-contact with each other. The tension roll 615 is disposed on the downstream side of the nip portion N, and gives a tension force to the fixing belt 610. The fixing belt 610 is also wound on the tension roll 615.

The fixing belt 610 is a flexible endless belt having a peripheral length of 314 mm and a width of 340 mm, for example. The fixing belt 610 includes a base layer, an elastic layer and a peel layer. The base layer is made of a polyimide resin having 80 μm in thickness. The elastic layer is made of silicone rubber, which has about 50 μm in thickness, and is deposited on the surface of the base layer (outer peripheral surface). The peel layer is made of a tetrafluoroethylene-perfluoro-alkyl vinyl ether copolymer resin (PFA) tube having 30 μm in thickness and is deposited on the elastic layer. For the composition of the fixing belt 610, the material, thickness and hardness may be selected appropriately in accordance with design of the image forming apparatus 1 such as intended purpose and use condition.

The fixing roll 611 is a hard roll formed by coating a cylindrical core roll (cored bar) made of aluminum having 65 mm in an outer diameter, 360 mm in a length, and 10 mm in a thickness with a fluorocarbon resin, which has 200 μm in thickness and serves as a protective layer for preventing metal abrasion of the surface. However, the fixing roll 611 is not limited to this composition. Any composition may be adopted so long as the fixing roll 611 functions as a sufficiently hard roll with almost no deformation upon reception of press force from the pressure roll 62 when forming the nip portion N between the fixing belt module 61 and the pressure roll 62. The fixing roll 611 receives a drive force from a drive motor (not shown) and rotates in an arrow C direction shown in FIG. 3 at a surface speed of 264 mm/sec.

The fixing roll 611 contains a halogen heater 616*a*, which is rated as 900 W and serves as a heating unit. The control section 40 of the image forming apparatus 1 (see FIG. 1) controls the surface temperature of the fixing roll 611 at 150° C. based on a measurement value of a temperature sensor 617*a* disposed so as to be in contact with the surface of the fixing roll 611.

The tension roll 612 is a cylindrical roll formed of aluminum having 30 mm in an outer diameter, 2 mm in a thickness and 360 mm in a length. The tension roll 612 contains thereinside a halogen heater 616*b*, which is rated as 1000 W and serves as a heating source. The temperature sensor 617*b* and the control section 40 (see FIG. 1) control the surface temperature of the tension roll 612 at 190° C. Therefore, the tension roll 612 has a function of heating the fixing belt 610 from the inner peripheral surface as well as the function of giving the tension force to the fixing belt 610.

A spring member (not shown) for pressing the fixing belt 610 outward is disposed at both ends of the tension roll 612 with 15 kgf in the tension force. The spring member uniformly gives the tension force to the fixing belt 610 over the width direction of the tension roll 612.

In order to reduce axial displacement of the fixing belt 610 as much as possible, the tension roll 612 may be formed like a crown shape in which an outer diameter of its center is made larger by 100 μm than that of its end portion.

Further, the tension roll 612 is swingable around a fulcrum 70, which is at an one end of the tension roll 612, in such a direction that the other end of the tension roll 612 is further apart from the fixing roll 611. The tension roll 612 forms a walk adjustment mechanism 70 (not shown in FIG. 3, but shown in FIG. 5).

The walk adjustment mechanism 70 swings the tension roll 612 under the control of the control section 40 so as to generate walk of the fixing belt 610 in a predetermined range. The configuration of the walk adjustment mechanism 70 and control of the control section 40 are described later in detail.

The tension roll 613 is a cylindrical roll formed of aluminum having 25 mm in an outer diameter, 2 mm in a thickness and 360 mm in a length. The tension roll 613 is formed on a surface with a release layer made of a fluorocarbon resin having 20 μm in a thickness. The release layer is formed to prevent slight offset toner and paper powder, which come from the outer peripheral surface of the fixing belt 610, from being deposited on the tension roll 613.

Like the tension roll 612, the tension roll 613 may be formed like a crown shape in which an outer diameter of its center is made larger by 100 μm than that of its end portion. In this case, both or either of the tension roll 612 and the tension roll 613 may be formed like a crown shape.

The tension roll 613 contains a halogen heater 616*c* thereinside, which is rated as 1000 W and serves as a heating unit. A temperature sensor 617*c* and the control section 40 control the surface temperature of the tension roll 613 at 190° C. (see FIG. 1). Therefore, the tension roll 613 has a function of heating the fixing belt 610 from the outer peripheral surface as well as the function of giving a tension force to the fixing belt 610. Therefore, in the exemplary embodiment, the fixing roll 611, the tension roll 612 and the tension roll 613 heat the fixing belt 610.

The tension roll 614 is a columnar roll formed of aluminum having 15 mm in an outer diameter and 360 mm in a length. The tension roll 614 is supported to be rotatable and defines the passage of the fixing belt 610 from the tension roll 612 to the fixing roll 611.

The peel pad 64 is a block-like member formed of a rigid body of metal such as SUS and a resin, with a length corresponding to the fixing roll 611. The peel pad 64 has a circular arc in cross section, defined by an inner face, a press face, an outer face 64*c* and an upper face 67*d*. The inner face 64*a* faces the fixing roll 611. The press face 64*b* presses the fixing belt 610 against the pressure roll 62. The outer face 64*c* has a predetermined angle with respect to the press face 64*b* so as to sharply change the traveling direction of the fixing belt 610.

As shown in FIG. 2, an arm 641 supports the peel pad 64 at both ends of the peel pad 64. The arm 641 is fitted to a support shaft 611*a* of the fixing roll 611 so as to be swingable. The peel pad 64 is disposed over all axial area of the fixing roll 611 inside the fixing belt 610 and on the downstream side of an area where the pressure roll 62 is in pressure-contact with the fixing belt module 61 (roll nip portion N1). An urging unit (not shown) such as a spring urges the peel pad 64 so that the peel pad 64 swings. The peel pad 64 presses the fixing belt 610 against the pressure roll 62 with the press face 64*b* at a predetermined load (for example, 10 kgf). Accordingly, the peel-pad nip portion N2 having 5 mm in a width is formed along the traveling direction of the fixing belt 610, for example.

The tension roll 615 is a columnar roll formed of aluminum having 12 mm in an outer diameter and 360 mm in a length. The tension roll 615 is disposed in the vicinity of the peel pad 64 and on the downstream side of the peel pad 64 in the traveling direction of the fixing belt 610 so that the fixing belt 610 passing through the peel pad 64 smoothly turns toward the fixing roll 611.

The pressure roll 62 is a soft roll including a columnar roll 621, an elastic layer 622 and a release layer 623 in order from the columnar layer 621. The columnar roll 621 is made of aluminum having 45 mm in an outer diameter and 360 mm in a length as a base body. The elastic layer 622 has 10 mm in a thickness and is made of silicone rubber having a rubber hardness 30° (JIS-A). The release layer 623 is made of a PFA tube having 150 μm in a film thickness. The elastic layer 622 and the release layer 623 are deposited in order on the base body. The pressure roll 62 is pressed against the fixing belt module 61. When the fixing roll 611 of the fixing belt module 61 rotates, the pressure roll 62 is driven by the fixing roll 611 and rotates in the arrow E direction shown in FIG. 3.

The described fixing device 60 performs fixing action as follows.

The secondary transfer section 20 of the image forming apparatus 1 (see FIG. 1) electrostatically transfers unfixed toner images onto a recording paper P, and the recording-paper transport mechanism 50 transports the recording paper P in an arrow F direction shown in FIG. 3. The recording paper P passes through the nip portion N and the toner images are fixed onto the recording paper P mainly with the heat and pressure acting on the roll nip portion N1.

At this time, the heat acting on the nip portion N is supplied mainly by the fixing belt 610. The fixing belt 610 is heated by (i) heat supplied through the fixing roll 611 from the halogen heater 616*a* disposed inside the fixing roll 611, (ii) heat supplied through the tension roll 612 from the halogen heater 616*b* disposed inside the tension roll 612 and (iii) heat supplied through the tension roll 613 from the halogen heater 616*c* disposed inside the tension roll 613. Thus, heat energy can be supplied appropriately and promptly to the fixing belt 610 mainly from the tension roll 612 and the tension roll 613. As a result, a sufficient heat amount can be provided in the nip portion N even if the process speed is high, e.g., 264 mm/s.

The fixing roll 611 forming a part of the roll nip portion N1 is the hard roll as described above and the pressure roll 62 forming a part of the roll nip portion N1 is the soft roll having the elastic layer 622 on the peripheral surface. Thus, the roll nip portion N1 of the exemplary embodiment is formed mainly by deformation of the elastic layer 622 of the pressure roll 62.

Thus, in the roll nip portion N1, the fixing roll 611 on which the fixing belt 610 is wound is hardly deformed. Therefore, the rotation radius of the fixing belt 610 rotating along the surface of the fixing roll 611 does not change. Thus, the fixing belt 610 can pass through the roll nip portion N1 with the travel speed kept constant. When the fixing belt 610 passes through the roll nip portion N1, a wrinkle and distortion do not occur. Consequently, an image disorder of a fixed image can be suppressed and a good fixed image can be provided stably. In the fixing device 60 of the exemplary embodiment, the roll nip portion N1 has 15 mm in width in the traveling direction of the fixing belt 610 (namely, nip width 15 mm).

After passing through the roll nip portion N1, the recording paper P moves to the peel-pad nip portion N2. The peel-pad nip portion N2 is formed to have a predetermined angle with respect to the roll nip portion N1, which is shaped like a downward convex bend because of the curvature of the fixing roll 611. Thus, the recording paper P heated and pressurized based on the curvature of the fixing roll 611 in the roll nip portion N1 changes in the traveling direction at a nip boundary point between the roll nip portion N1 and the peel-pad nip portion N2. As a result, the adhesion force between the toner images and the fixing belt 610 is weakened and the recording paper P becomes easy to peel off from the fixing belt 610.

At the exit of the peel-pad nip portion N2, the fixing belt 610 rotates so as to wind on the peel pad 64 from the press face 64*b* to the outer face 64*c* and the traveling direction of the fixing belt 610 changes sharply. Accordingly, the recording paper P naturally peels off from the fixing belt 610 because of flexibility of the recording paper P. This means that the recording paper P is stably detached from the fixing belt 610 when the recording paper P exits the peel-pad nip portion N2.

The recording paper P detached from the fixing belt 610 is discharged to the outside of the image forming apparatus 1 by a paper discharge guide 65 and a paper discharge roll 66, and the fixing processing is completed.

In the fixing operation, the walk adjustment mechanism 70 driven by the control section 40 controls walk of the fixing belt 610.

The control section 40 performs variable control of the walk width according to a width of the recording paper P. The configuration of the walk adjustment mechanism 70 and control in the fixing operation will be discussed below.

The walk adjustment mechanism 70 swings the tension roll 612, which is swingably supported by the supporting point 70C at one end of the tension roll 612, as shown in FIG. 5.

That is, the walk adjustment mechanism 70 includes a rack gear 71, a pinion gear 72 and a steering motor 73. The rack gear 71 is fixed to a movable end of the tension roll 612. The pinion gear 72 engages with the rack gear 71. The steering motor 73 drives the pinion gear 72. When the steering motor 73 rotates the pinion gear 72, the rack gear 71 is moved. As a result, the tension roll 612 is swung around the supporting point 70C.

The walk adjustment mechanism 70 swings the tension roll 612, to thereby cause a difference in tension force between the left side and right side of the fixing belt 610. Consequently, the fixing belt 610 wound on the tension roll 612 moves to the side to which the smaller tension force is given. Therefore, if the position of the fixing belt 610 wound on the tension roll 612 is displaced from the neutral position to one side, the tension roll 612 may be swung so that the tension of the fixing belt 610 on the displacement side becomes large. Thereby, the wound position of the fixing belt 610 can be moved to the opposite side.

The control section 40 controls the walk adjustment mechanism 70 based on detection information of a belt-position detection mechanism 41, which detects a position of the fixing belt 610.

The belt-position detection mechanism 41 faces the traveling passage of the fixing belt 610 from the tension roll 615 to the fixing roll 611 as shown in FIGS. 3 and 4. The belt-position detection mechanism 41 detects the position of a side edge of the fixing belt 610 in a direction orthogonal to the traveling direction (the position of the fixing roll 611 in the axial direction), and outputs the detection information to the control section 40.

In the exemplary embodiment, the control section 40 controls the walk width of the fixing belt 610 so as to be two different widths as described later. Thus, the belt-position detection mechanism 41 need not output every position information of the side edge of the fixing belt 610. The belt-position detection mechanism 41 may be made up of two sensors corresponding to two walk widths of the fixing belt 610 (namely, two types of sensors different in the detection range). Alternatively, the belt-position detection mechanism 41 may be configured so that a single sensor is moved to be close to and apart from the fixing belt 610 so as to change the detection range of the sensor and cover two walk widths of the fixing belt 610.

The control section 40 performs swing control of the tension roll 612 through the walk adjustment mechanism 70 so that the fixing belt 610 is located in a predetermined range, based on the detection information input from the belt-position detection mechanism 41. Accordingly, the fixing belt 610 rotates between the fixing roll 611 and the tension roll 612 while walk from one side to the other side in the predetermined range (walk width).

The control section 40 controls the fixing belt 610 so that the walk width of the fixing belt 610 when an image is formed on recording paper P having a maximum width on which an image can be formed is different from the walk width of the fixing belt 610 when an image is formed on recording paper P having a smaller width than the maximum width.

Figure 6:
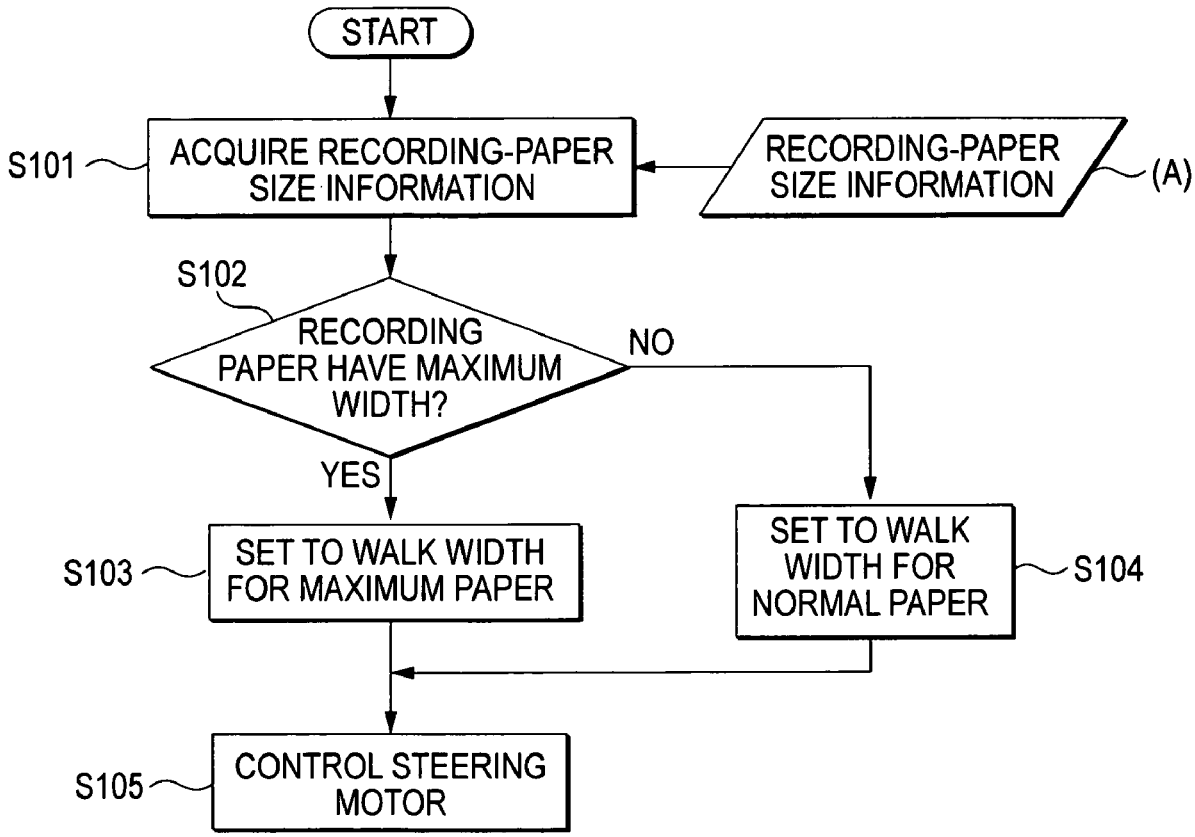
FIG. 6 is a flowchart of walk width control of the fixing belt, performed by a control section.

FIG. 6 is a flowchart of walk width control of the fixing belt 610, performed by the control section 40.

That is, the control section 40 acquires recording-paper size information from image formation information or through an operation panel (S101). Then, the control section 40 judges whether or not a width of the recording paper is equal to the maximum width (S102). For example, it is assumed that a maximum width for an image forming apparatus 1 is equal to A3 longitudinal feed. In this case, when a recording paper is A3 or a recording paper of A4 is fed transversely, the control section 40 judges that the width of the recording paper is equal to the maximum width.

If the width of the recording paper is equal to the maximum width, the control section 40 sets the walk width of the fixing belt 610 to a predetermined width (walk width for the maximum paper) (S103). Otherwise, the control section 40 sets the walk width of the fixing belt 610 to a walk width for a normal paper, which is larger than the walk width for the maximum paper (S104). The control section 40 controls the steering motor 73 of the walk adjustment mechanism 70 (see FIG. 5) so that the walk width of the fixing belt 610 is equal to the corresponding set walk width (S105) and then, the fixing operation is performed.

Figure 7B:
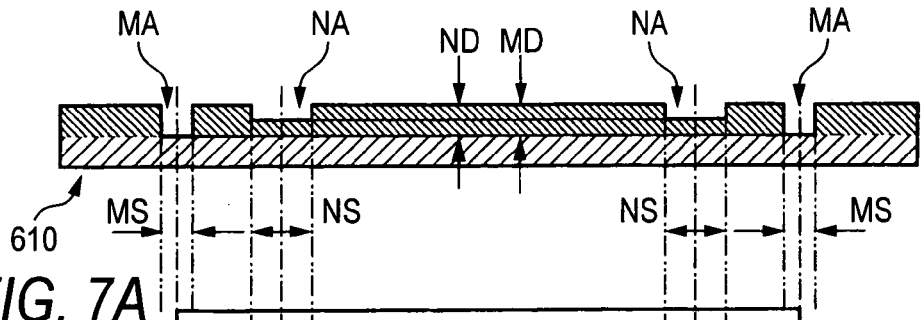
FIG. 7 is a schematic representation of settings of the walk width of the fixing belt and its advantage.
Figure 7A:
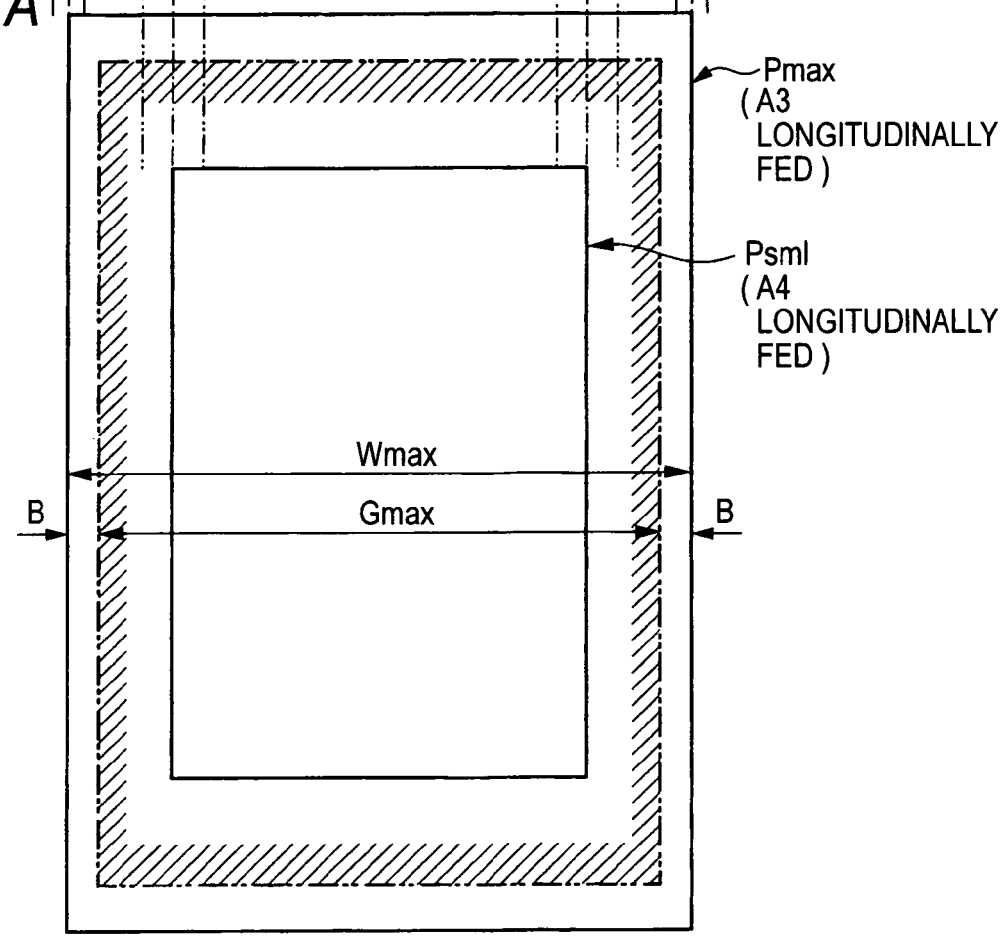

Next, the width of the recording paper and settings of the walk width of the fixing belt 610 will be described. FIG. 7 is a schematic view showing settings of the walk width of the fixing belt 610 and its advantage. FIG. 7A is a plan view of recording paper P (Pmax, Psml). FIG. 7B is a sectional view of the fixing belt 610. The upper side in FIG. 7B corresponds to a surface of the fixing belt 610, which comes in contact with recording paper P. Actually, the fixing belt 610 moves from side to side and walks relatively to the recording paper P, which moves on a given passage. However, FIG. 7 shows that the recording paper P moves from side to side relatively to the fixing belt 610.

To form an image on recording paper having the maximum width (recording paper Pmax having maximum width), the walk width of the fixing belt is set to a walk width MW for the maximum paper. The walk width MW for the maximum paper is less than a half (=maximum image margin width B) of a difference between the whole width Wmax of the recording paper Pmax having the maximum width and a maximum image formation width Gmax. To form an image on recording paper (recording paper Psml having small width) having a smaller width than the recording paper Pmax having the maximum width, the walk width is set to a walk with NW for the normal paper. The walk width NW for the normal paper is larger than the walk width MW for the maximum paper. The walk width NW for the normal paper may be made large as much as possible. Specifically, the walk width NW for the normal paper may be set to a maximum value that can be allowed by the fixing device 60.

For example, if the recording paper Pmax having the maximum width is achieved by feeding A3 recording paper longitudinally in parallel to the long side of the A3 recording paper, the walk width MW for the maximum paper is set less than the maximum image margin width B. In contrast, if an image is formed while A4 recording paper is being fed longitudinally (that is, the recording paper Psml having the small width is being fed), the walk width NW for the normal paper is set to be twice as large as the walk width MW for the maximum paper.

According to the above settings, abrasion areas MA of the fixing belt 610 (peel layer), which is caused by side edges of A3 recording paper, do not overlap the image formation area of the A3 recording paper even if the fixing belt 610 walks. Of course, the abrasion areas MA do not overlap the image formation area of recording paper smaller than the A3 recording paper. That is, the abrasion areas MA do not overlap the image formation area of recording paper having any size on which the image forming apparatus can form an image. Also, abrasion of the fixing belt 610 does not cause a fixed image failure to occur.

On the other hand, abrasion areas NA of the fixing belt 610, which is caused by side edges of A4 recording paper, correspond to the walk width NW for the normal paper. Thus, the abrasion areas NA become wider than the abrasion areas MA, which is caused by the side edges of A3 recording paper, and an abrasion depth MD shallows accordingly.

That is, if the walk width NW for the normal paper is twice as large as the walk width MW for the maximum paper, an abrasion depth ND of the abrasion areas NA remains a half of the abrasion depth MD of the abrasion areas MA. Therefore, if a comparison is made with the case where the walk width NW for the normal paper is equal to the walk width MW for the maximum paper, the number of sheets subjected to the fixing process until abrasion of the same depth is caused to occur becomes twice.

Next, results of evaluation test conducted with the configuration (example 1) to which the exemplary embodiment is applied and comparative examples to which the exemplary embodiment is not applied will be described.

Table 1 lists the test results.

In this evaluation test, the recording paper (Pmax) having the maximum width is A3 paper longitudinally fed, and the recording paper (Psml) having the small width is A4 paper longitudinally fed.

In the example 1, the walk width for the recording paper having maximum width (walk width MW for the maximum paper) is set to 2 mm. Also, the walk width of the recording paper having the small width (the walk width NW for the normal paper) is set to 10 mm.

In the comparative example 1, the control section 40 does not perform walk control with respect to the recording paper having the maximum width and the recording paper having the small width (walk width 0 mm). In the comparative example 2, the walk widths for the recording paper having the maximum width and that for the recording paper having the small width are set each to 10 mm.

A testing method is described below. For each of the recording paper having the maximum width and the recording paper having the normal width, 500 sheets are treated as one set. Five sets of each paper, that is, 5,000 sheets in total pass through the fixing device of each example. Then, a black solid image was fully formed on cast coated paper having 256 g/m$^2$ in basis weight, which is the recording paper having the maximum width (A3) having 3 mm in a margin. Then, the presence/absence of a fixed image failure such as image unevenness and gloss unevenness is visually observed and judgment is made.

In Table 1, sign "o" means no occurrence of fixed image failure and sign "x" means that occurrence of fixed image failure is observed.

TABLE 1

| | Comp. example 1 | Comp. example 2 | Example 1 |
|---|---|---|---|
| Fixed image failure due to abrasion caused by side edges of recording paper having a small width | X | ○ | ○ |
| Fixed image failure due to abrasion caused by side edges of recording paper having a maximum width | ○ | X | ○ |

As shown in Table 1, in the comparative example 1, occurrence of image unevenness and/or gloss unevenness due to abrasion caused by side edge of the recording paper having the small width is observed. In the comparative example 2, occurrence of image unevenness and/or gloss unevenness due to abrasion caused by side edges of the recording paper having the maximum width is observed. In contrast, in the example 1, occurrence of image unevenness and gloss unevenness due to abrasion is not observed. Also, the suppression effect of fixed image failure due to abrasion of the fixing belt 610 and the enhancement effect of durability are confirmed.

The invention is not limited to the specific embodiment described above. The exemplary embodiment is provided by applying the invention to an image forming apparatus of tandem type; however, for example, the invention may be applied to a color image forming apparatus using rotary developing devices, a monochrome copier, etc., needless to say.

The exemplary embodiment employing the pressure roll 62 as the pressure member, which is pressed against the fixing belt module 61, has been described above. However, the invention may be applied to other configurations employing a pressure belt module having a pressure belt wound on plural rolls as pressure members.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device for fixing a toner image carried on a recording medium, the fixing device comprising:

a rotatable fixing roll member;

a fixing belt member wound on the fixing roll member so as to be rotatable; and a walk adjustment mechanism that changes a walk width of the fixing belt member in accordance with a width of the recording medium, wherein the walk adjustment mechanism changes the walk width of the fixing belt member between one walk width for a recording medium having a maximum width and another walk width for recording media other than the recording medium having the maximum width, and wherein the walk adjustment mechanism adjusts the walk width of the fixing belt member so that the walk width for the recording medium having the maximum width is less than a margin width of the recording medium having the maximum width in an orthogonal direction with respect to a traveling direction of the recording medium.

2. The fixing device according to claim 1, wherein the walk adjustment mechanism adjusts the walk width of the fixing belt member so that the walk width for the recording media other than the recording medium having the maximum width is larger than that for the recording medium having the maximum width.

3. The fixing device according to claim 1, further comprising:

a pressure roll member that comprises an elastic layer on a surface, the pressure roll member that is in pressure-contact with a portion of the fixing roll member on which the fixing belt member is wound, to form a nip portion between the pressure roll member and the fixing roll member.

4. The fixing device according to claim 3, further comprising:

a peel member that bends the fixing belt member to peel off the recording medium from the fixing belt member, the peel member disposed on a downstream side of the nip portion in a rotation direction of the fixing roll member, the peel member disposed between the fixing belt member and the fixing roll member.

5. The fixing device according to claim 1, further comprising:

a rotatable tension roll member, wherein:

the fixing belt member is wound on the fixing roll member and on the tension roll member, and the walk adjustment mechanism swings the tension roll member so as to adjust the walk width of the fixing belt member.

6. An image forming apparatus comprising:

an image forming unit that forms a toner image;

a transfer unit that transfers the toner image formed by the image forming unit onto a recording medium;

a fixing device that fixes the toner image transferred onto the recording medium; and a control unit that controls the fixing device, wherein:

the fixing device comprises:

a rotatable fixing roll member;

a fixing belt member wound on the fixing roll member so as to be rotatable; and a walk adjustment mechanism that can change and adjust a walk width of the fixing belt member, and the control unit controls the walk adjustment mechanism so that the walk width of the fixing belt member differs in accordance with a width of the recording medium on which an image is formed, wherein when an image is formed on a recording medium having a maximum width, the control unit controls the walk width of the fixing belt member so that an area where a side edge of the recording medium having the maximum width abuts against the fixing belt member does not overlap an image formation area of the recording medium having the maximum width.

7. The apparatus according to claim 6, wherein the control unit controls the walk width of the fixing belt member so that the walk width for recording media other than the recording medium having the maximum width is larger than that for the recording medium having the maximum width.

8. A control method of an image forming apparatus, which fixes a toner image onto a recording medium by a fixing device comprising a fixing belt member, the method comprising:

acquiring information of a size of the recording medium;

judging a width of the recording medium; and setting a walk width of the fixing belt member to different widths in accordance with the judged width of the recording medium, wherein the setting sets the walk width of the fixing belt member so that the walk width for a recording medium having a maximum width is different from that for recording media other than the recording medium having the maximum width, and is less than a margin width of the recording medium having the maximum width in an orthogonal direction with respect to a traveling direction of the recording medium.

9. The method according to claim 8, wherein the setting sets the walk width of the fixing belt member so that the walk width for the recording media other than the recording medium having the maximum width is larger than that for the recording medium having the maximum width.

10. The fixing device according to claim 1, wherein the tension roll member is swingable around a fulcrum which is at an one end of the tension roll member.

* * * * *